United States Patent [19]

Vinette

[11] 4,424,972

[45] Jan. 10, 1984

[54] GAME APPARATUS

[76] Inventor: Richard H. Vinette, P.O. Box 191, Lanesboro, Mass. 02137

[21] Appl. No.: 246,978

[22] Filed: Mar. 24, 1981

Related U.S. Application Data

[63] Continuation-in-part of Ser. No. 156,443, Jun. 4, 1980, Pat. No. 4,272,078, which is a continuation-in-part of Ser. No. 31,902, Apr. 20, 1979, abandoned.

[51] Int. Cl.[3] ..... A63B 65/12

[52] U.S. Cl. ..... 273/397; 273/399; 124/77; 124/56; 124/41 C

[58] Field of Search ..... 124/56, 73, 74, 75, 124/76, 77, 71, 72, 60, 69, 41 C; 273/394, 396, 397, 398, 399, 355, 356

[56] References Cited

U.S. PATENT DOCUMENTS

| | | | |
|---|---|---|---|
| 973,488 | 10/1910 | Eaves | 273/397 |
| 1,063,119 | 5/1913 | Clifford . | |
| 1,540,350 | 6/1925 | Longenecker . | |
| 1,931,841 | 10/1933 | Evans . | |
| 2,164,808 | 7/1939 | Everett . | |
| 2,701,140 | 2/1955 | Fortino . | |
| 3,037,776 | 6/1962 | Younce . | |
| 3,104,879 | 9/1963 | Jetton . | |
| 3,260,257 | 7/1966 | Younce . | |
| 3,578,333 | 5/1971 | Elesh . | |
| 3,599,980 | 8/1971 | Harmond . | |
| 3,662,729 | 5/1972 | Henderson | 124/73 |
| 3,695,246 | 10/1972 | Filippi et al. | 124/77 |
| 3,708,173 | 1/1973 | Hewson . | |
| 4,021,037 | 5/1977 | Torbet | 124/56 |
| 4,272,078 | 6/1981 | Vinette | 273/182 |

*Primary Examiner*—George J. Marlo
*Attorney, Agent, or Firm*—Darle M. Short

[57] ABSTRACT

A new game apparatus including a shooting device for shooting a ball and a target when the shooting device is loaded, balls are either shot automatically by the shooting device, or by a trigger operated by the user. The shooting device includes a pressurizable ball receiving chamber into which the ball to be played enters when the player is ready to shoot the shooting device. The ball enters the chamber through a first hole in the chamber. The shooting device also includes a door for closing this first hole, a source of fluid under pressure and a switch and solenoid assembly for admitting the fluid into the chamber in a sufficient amount to drive the ball from the chamber through a second hole in the chamber. The second hole leads to an exit conduit through which the ball is projected out into the open air. The chamber is closed off upon the initial pressurization of the chamber by the door and by the ball. As more pressure is added, sufficient pressure builds up to propel the ball out the second hole. The target has holes therein to which the shooting device and exit conduit are aimed, the object being to shoot a ball into one of the target holes. In certain embodiments, separate automatic ball return systems are provided to distinguish balls that go in the target holes from balls that miss the target holes. In other embodiments a control unit is provided to receive the balls from the ball return systems and to dispense balls to the shooting device.

10 Claims, 5 Drawing Figures

GAME APPARATUS

CROSS-REFERENCE TO RELATED APPLICATIONS

This application is a continuation-in-part of my copending application, Ser. No. 156,443 filed June 4, 1980, now U.S. Pat. No. 4,272,078, which in turn is a continuation-in-part of my earlier application, Ser. No. 031,902 filed Apr. 20, 1979, now abandoned.

This invention relates to games where the object is to project a ball into a target hole. In particular, this invention relates to such games that include mechanical and electronic devices for projecting a ball to a target area.

There are many games now played that involve the projection of a ball towards a target or a predetermined location. Some examples are batting practice devices, trick shot arcades, shooting target practice ranges and large size pinball type games. These games are becoming increasingly popular, along with all types of pinball and electronic games.

However, none of the games now available involve an electromechanical device which projects a ball toward a target at a remote location, a quick retrieval of most balls fired at the target without interrupting the game, and a control room for dispensing balls to play. Electromechanical devices, on the whole, are found by the public to be more exciting to play and more challenging to master than games involving the mere throwing or hitting of a ball.

In view of the above, it is apparent that there exists a need in the art for a game involving an electromechanical device for projecting balls at a target wherein the game can be adapted such that the balls once fired are quickly returned without interrupting the playing of the game to a control unit for re-dispensing to the players. It is the purpose of this invention to fulfill this and other needs apparent to the skilled artisan once given the following disclosure:

SUMMARY OF THE INVENTION

Generally speaking, this invention provides a game comprising projecting means for projecting balls, a target, said target having at least one hole therein to receive said balls, at least one ball ejection unit including a pressurizable ball receiving chamber having a ball entrance opening therein, a door for closing said opening, an exit located in said ball receiving chamber through which said ball is able to pass when the chamber is under pressure, a source of fluid under pressure, means for admitting the fluid under pressure into said chamber in an amount sufficient to drive the ball from the chamber, said projecting means including a first said ball ejection unit.

In some embodiments of this invention the game includes a control room to which the balls are returned once played and from which balls are dispensed to the players.

In certain embodiments of this invention the player has a control lever attached to the projecting means to aim the projecting means at the target. The projecting means can be activated either automatically (by an electronic sensor that senses the ball entering the chamber or a switch that the ball contacts when it enters the chamber) or by a trigger-like device activated by the player when the ball is in the chamber and the player is ready to project the ball.

In other embodiments of this invention second and third ball ejection units are connected by piping to the target holes, to holes located adjacent the target and to the control unit. These ball ejection units and the associated piping supply the means to get the balls from the target area back to the control unit for re-dispensing to the players without interrupting the playing of the game. In addition, these ball ejection units and the associated piping may be located under the surface on which the other elements of the game rest for aesthetic appeal and so that they do not interfere with the projection of the ball. The balls which are "on target" are returned to the control unit via a different piping than the "miss" balls which are also returned to the control unit. The balls are separately returned so that the players who have successfully projected a ball into a target hole can be identified (via color coding on the ball, etc.) and properly rewarded.

This invention will now be described with respect to certain embodiments thereof as illustrated in the accompanying drawings, wherein:

IN THE DRAWINGS

DETAILED DESCRIPTION OF THE DRAWINGS

Figure 3:
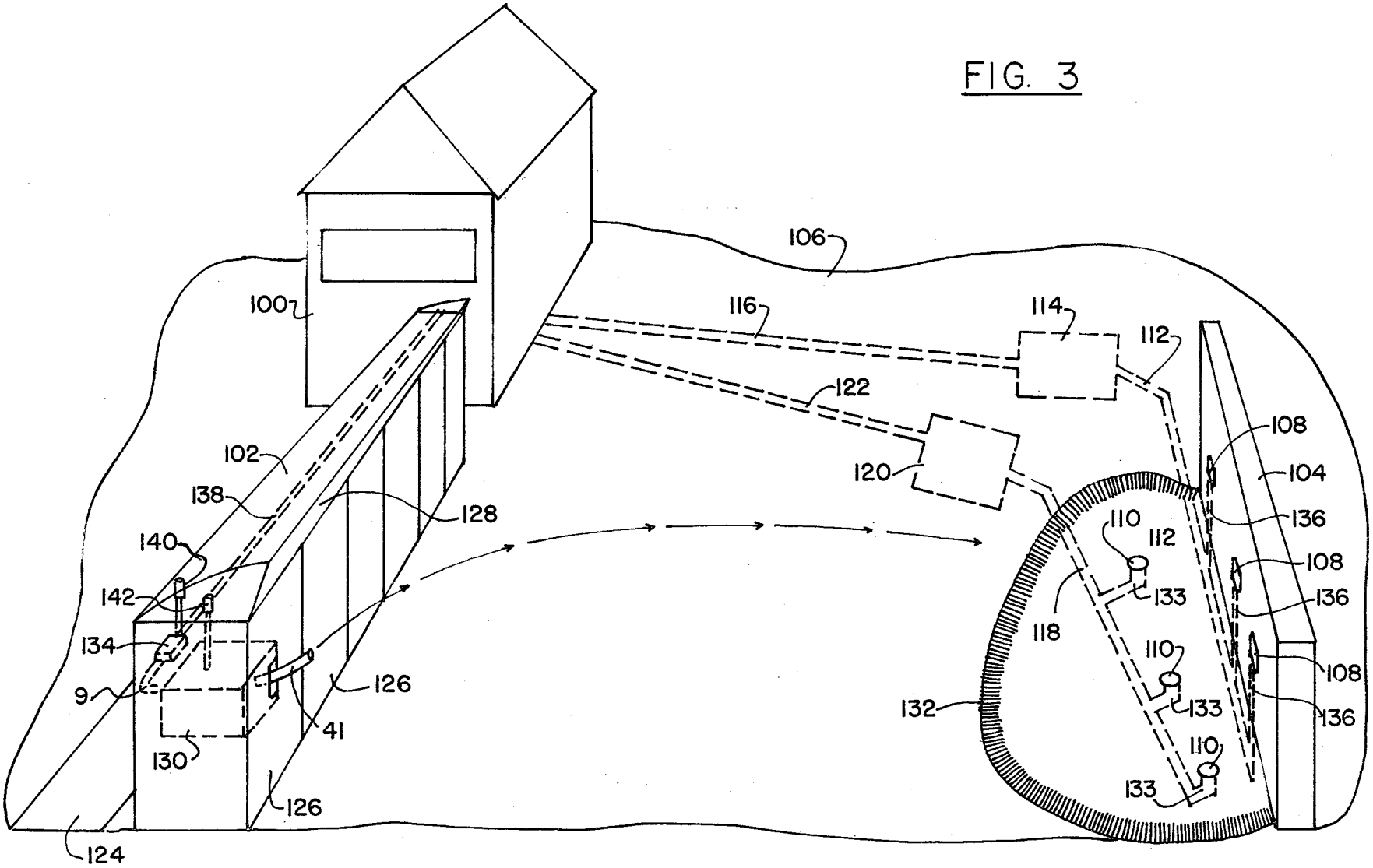
FIG. 3 is a perspective view of one embodiment of the game apparatus according to this invention.
Figure 5:
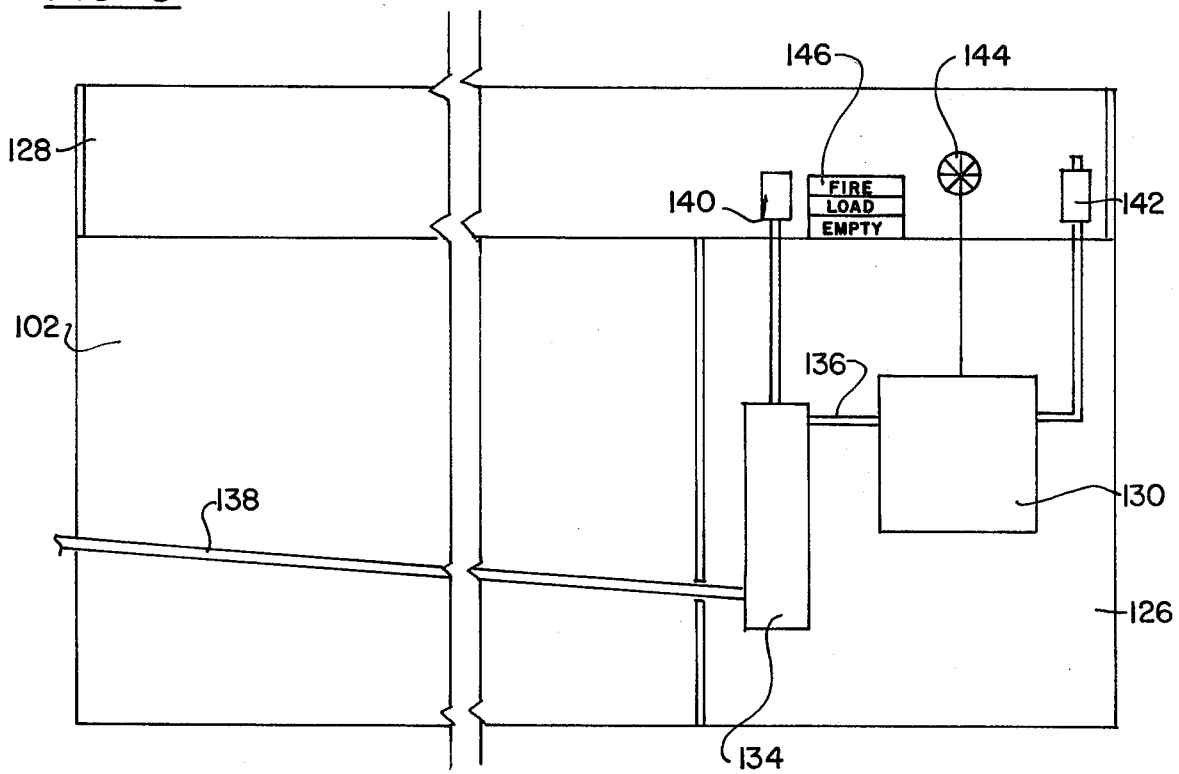
FIG. 5 is a plan view of the shooting bay illustrated in FIG. 4, this plan view being from behind the shooting bay where the player would stand.
Figure 4:
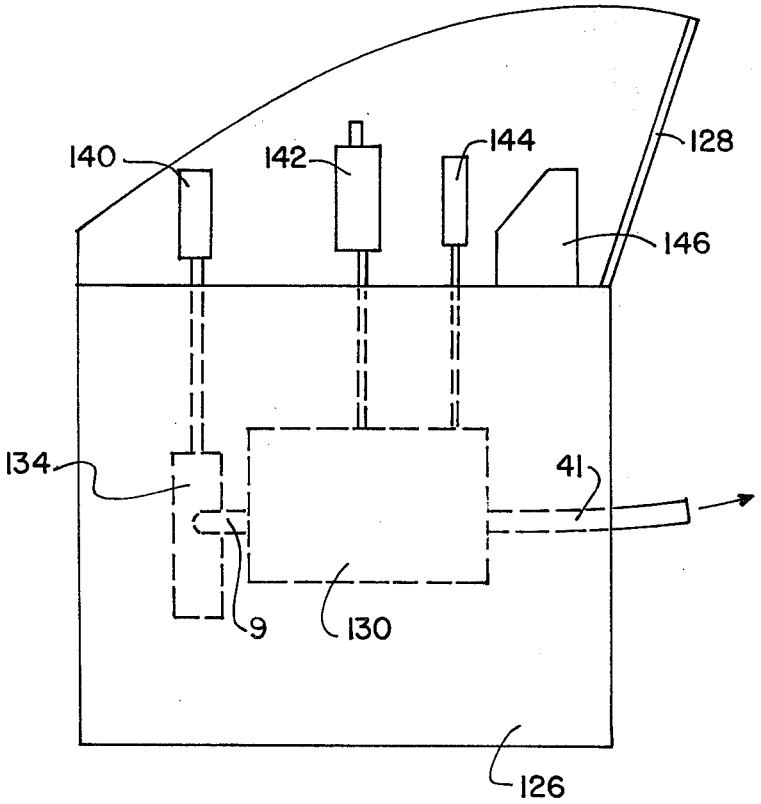
FIG. 4 is a side view, partially sectionalized, of one embodiment of a shooting bay according to this invention.

Referring to the Figures, and in particular FIGS. 3–5, the embodiment of this invention illustrated therein consists of three main elements; target stand 104, control unit 100 and shooting console 102. All three of these elements are standing on surface 106 which can be ground, asphalt, concrete, etc.

Target stand 104 is remotely located from shooting console 102 by a distance dependent on the power of ball projector units 130 (located in shooting console 102) and the degree of difficulty it is desired to make the game. In this embodiment, control unit 100 is located adjacent shooting console 102 so that the balls used in playing the game can be easily transmitted to shooting console 102 from control unit 100 by gravity.

Target stand 104 has target holes 108 located therein for the player of this game to aim at. Pipes 136 are vertical pipes partially located within target stand 104 that open up at the upper end in target holes 108 and at the lower end into return pipe 112. Return pipe 112 slopes downward from pipes 136 and connects into ball ejector unit 114 (described in detail with respect to FIGS. 1 and 2). Return pipe 116 extends out the opposite side of ball ejector unit 114 and runs into control unit 100. All the pipes included in this invention must, of course, have an interior diameter larger than the diameter of the balls being used so that the balls freely roll through the pipes.

Thus, if the player playing this embodiment is successful in getting a ball in one of the target holes 108, the ball will travel down the complementary pipe 136 into return pipe 112. Since return pipe 112 is sloped towards the ball ejector unit 114, the ball will proceed into ball ejector unit 114. Ball ejector unit 114 applies enough force to the ball such that it is driven through return pipe 116 into control unit 100. The ball is then dispensed from control unit 100 back to shooting console 102 by personnel within control unit 100.

Located on surface 106 adjacent target stand 104 is sloped area 132. Sloped area 132 has holes 110 spaced throughout and slopes from its periphery downward to the holes 110. Pipes 133 are located under surface 106 such that one end thereof opens up into hole 110. The other ends of pipes 133 open up into return pipe 118 which in turn feeds into ball ejector unit 120. Return pipe 118 slopes downhill from pipes 133 to ball ejector unit 120. Coming out the other side of ball ejector unit 120 is return pipe 122 which connects ball ejector unit 120 with control unit 100.

If a player shoots a ball and hits target stand 104 but misses target holes 108, the ball will bounce off target stand 104 and most likely land in sloped area 132. The ball will then roll without the application of any outside forces into one of the holes 110, through one of pipes 133 and into ball ejector unit 120. Ball ejector unit 120 then applies a sufficient force on the ball to propel it through return pipe 122 into control unit 100.

Control unit 100 can be any type of hut, etc., wherein the persons managing the playing of the game can receive money, dispense balls to the players, etc.

Shooting console 102 is comprised of a series of individual shooting bays 126. There is a plastic protective shield 128 located along the front of shooting console 102. The shooter's standing area 124 is located behind shooting console 102. The shooting bays 126 are illustrated in detail in FIGS. 4 and 5 and include loading device 134, shooter 130 and exit conduit 41. Each of the shooting bays 126 is connected to control unit 100 by a conduit 138 which runs downhill from control unit 100 to shooting bays 126 so that any balls placed in a conduit 138 in control unit 100 will be propelled by gravity to the respective shooting bay 126. Conduit 138 terminates within shooting bay 126 at loading device 134. Thus, any ball placed in a conduit 138 at control unit 100 will end up in the complementary loading device 134. Loading device 134 will feed a ball into shooter 130 whenever loading lever 140 is activated. In the embodiment shown in the Figures, whenever the player pulls the loading lever 140, a ball will be lifted from the level of conduit 138 into pipe 9 and thus shooter 130, by loading device 134. Since devices which can perform this function are well known in the art, loading device 134 is not illustrated in any detail.

In the embodiment of this invention illustrated in FIGS. 4 and 5 shooting bays 126 also include indicators 146, sights 144 and shooting control lever 142. Shooting control lever 142 is connected to shooter 130 and is used by the player to position the shooter. Control lever 142 can be used to raise or lower shooter 130 and/or to move it from left to right. Indicator 146 is connected electrically to loading device 134 and to shooter 130 to indicate to the player the state that these elements are in (i.e. "load", "fire", and "empty"). Sight 144 can be used by the player to "zero in" on the target before the player activates shooter 130.

Figure 1:
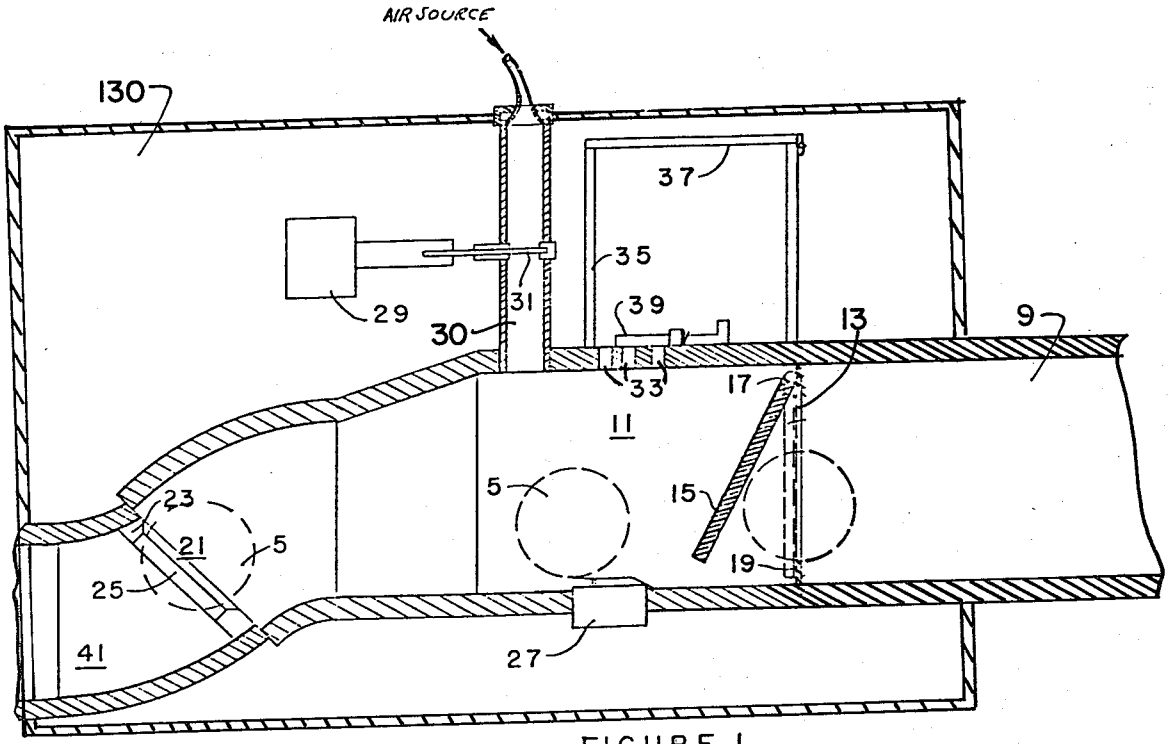
FIG. 1 is a sectionalized side view of one embodiment of a ball ejection unit according to this invention.

In certain embodiments of this invention, shooter 130, ball ejector unit 120 and ball ejector unit 114 are all constructed as shown in FIG. 1. Conduit 9 (as well as pipes 112 and 118) has an opening 13 which leads into a ball-receiving chamber 11. This opening 13 is sealable by a door 15 which swings open or is closed about hinge 17. The hinge 17 and door 15 work in a manner so as to enable door 15 to open inwardly into chamber 11 upon contact by ball 5 (as shown in dotted lines). In other words, since door 15 is made of a simple thin metal or plastic plate, it can be easily opened to allow ball 5 to enter chamber 11. Gasket 19 surrounds opening 13 so as to provide an effective seal (with door 15) during pressurization of chamber 11.

Chamber 11 is preferably level or tilted slightly downwardly from opening 13 to its exit 21. If tilted slightly, such as at a 6°–8° angle from the horizontal, a positive gravitational force serves to move ball 5 through the chamber to the orifice until it lodges in or proximal opening 25 (as shown in dotted lines), thereby to substantially close off exit 21 during pressurization of chamber 11. When horizontal, the momentum of ball 5 falling down conduit 9 is usually sufficient to achieve the same close-off condition, while at the same time allowing door 15 to swing fully closed by gravity rather than relying upon the initial thrust of pressurization against door 15 to achieve closure of opening 13. Either situation, however, is operative for their intended purposes.

Exit 21 has located therein a rubber or plastic bushing 23. In one embodiment, orifice 25 is slightly larger than the diameter of ball 5 such that ball 5 can just pass through orifice 25. In another embodiment orifice 25 is slightly smaller than the diameter of ball 5 such that ball 5 initially plugs orifice 25 when located therein. In this latter embodiment bushing 23 is made of a conventional stretchable rubber or plastic so that when the chamber 11 is pressurized to its desired extent, the force exerted on the rearward portion of ball 5 is sufficient to propel the ball through the stretched bushing into conduit 41 (or pipes 116 and 122). It is to be noted that exit 21 is at a level lower than opening 13 so that regardless of whether chamber 13 is generally level or tilted downward, ball 5 will lodge in or proximal to orifice 25, and either before or in the initial stages of pressurization will substantially close off exit 21. It is also to be noted that the internal diameter of conduit 41 (and pipes 116 and 122) is preferably only slightly larger than the diameter of ball 5, thereby to maximize the effect of the pressurization on the return of ball 5 to its ball return area.

To actuate the flow of fluid (e.g., air) into chamber 11, thereby to pressurize it, there is located in the path of ball 5 as it enters chamber 11 a conventional trip switch 27. Switch 27 is normally biased in the open position and is connected in conventional electrical fashion to solenoid valve 29. Valve 29 is of conventional design and includes a valve gate 31 which is normally closed but which may be opened for a preselected period of time by the closing of switch 27 to thereby admit a burst of fluid from a pressurized fluid source (not shown) into chamber 11, via conduit 30 in which valve 29 is located. In the embodiment illustrated in FIG. 1, conduit 30 enters chamber 11 at a point slightly in advance of switch 27. In other embodiments conduit 30 may be located so as to enter chamber 11 behind switch 27. In either event, conduit 30 in combination with the timing of solenoid 29 activated by switch 27 should be so located that when fluid rushes outwardly therefrom into chamber 11, it does not force ball 5 backwardly or otherwise prevent it from being ejected from the chamber.

Valve 29 may be of a simple and inexpensive construction or if desired may be of a variable timed type so as to be able to adjust the time that gate 31 remains open and thus the amount of pressure built up in chamber 11. Alternatively, such as when a simple nonadjustable valve 29 is employed, pressure built up in chamber 11 may be varied by the use of a plurality of adjustment orifices 33 located in a wall of chamber 11. For convenience, three orifices 33 are shown. However, one large orifice might be employed or any other number might be used to fit a particular situation.

Container 35 protects orifices 33 from being clogged with dirt, etc., and is provided with a flip up lid 37 for easy access to the orifices for adjustment. Orifices 33 may be vented or closed by adjusting slide plate 39. In the embodiment illustrated slide plate 39 closes off two of orifices 33 leaving one vented to the container. By sliding plate 39 to the right or left, any portion of or the entire opening in any one of orifices 33 may be adjusted so as to provide the proper pressure in chamber 11 for propelling ball 5 out of chamber 11 with the desired force.

Generally speaking the apparatus illustrated in FIG. 1 is operated in the following manner:

As a ball 5 passes by gravity through conduit 9 it contacts door 15, pushing door 15 open and enters chamber 11. Switch 27 being located near opening 13 and in the path of ball 5, is pushed closed, activating solenoid valve 29. In the meantime, ball 5 has proceeded on past conduit 30 and lodged either in bushing 23 or is proximal to it, thereby to substantially close exit 21.

The flow of fluid (air) from conduit 30 pressurizes chamber 11 to the extent dictated by the adjusting means employed. In this respect, the initial phases of pressurization close door 15 shut, preventing any other ball from entering chamber 11. Gasket 19 seals the closure thereby maximizing the effect of the pressurization. This pressurization "blows" ball 5 located at exit 21 out of orifice 25 with sufficient force to return it to its desired location via conduit 41.

Figure 2:
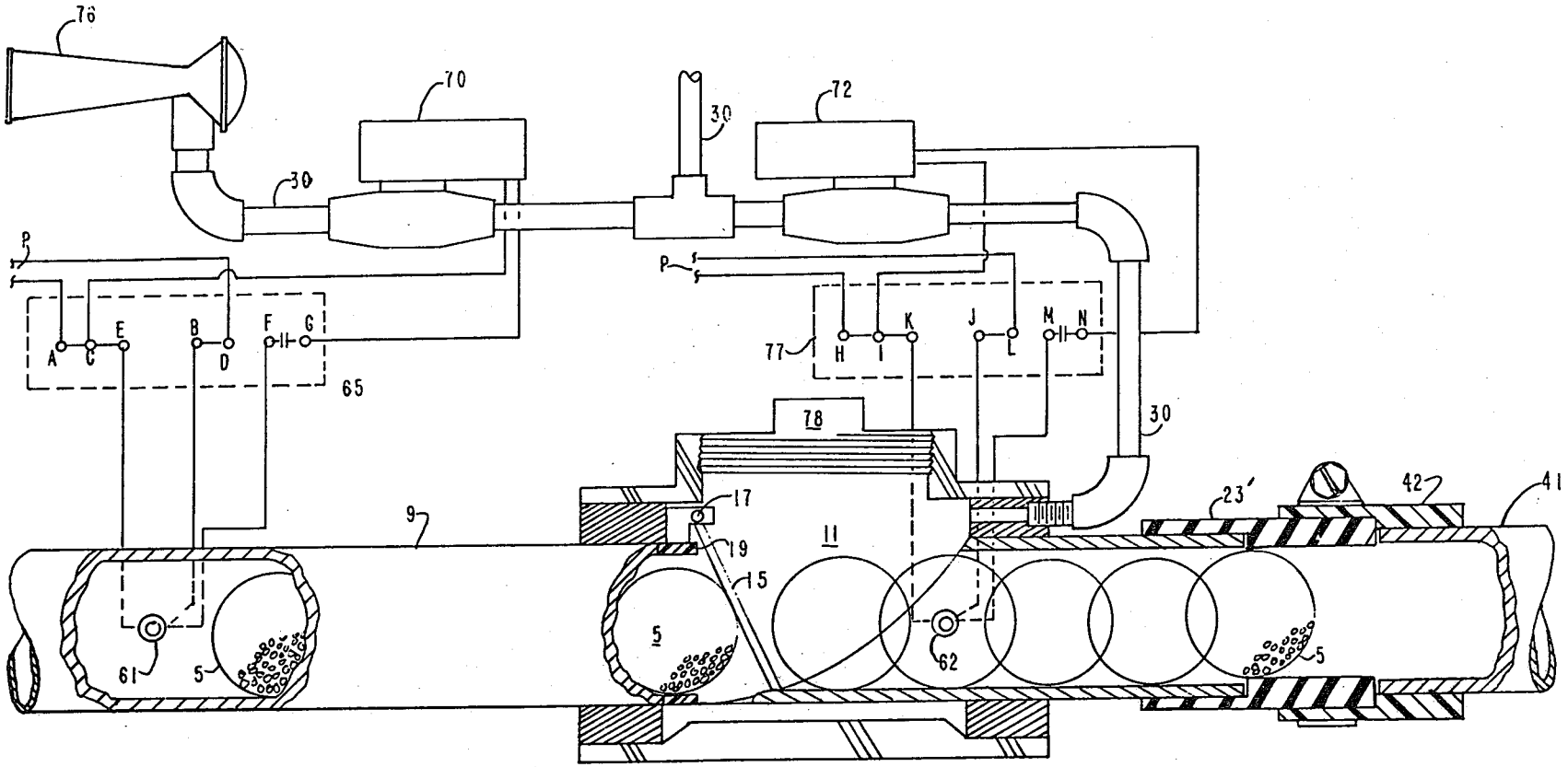
FIG. 2 is a sectionalized side view of a second embodiment of a ball ejection unit according to this invention.

With reference to FIG. 2, there is shown a modified embodiment of the apparatus illustrated in FIG. 1. In this embodiment, like parts similar to those shown in FIG. 1 are similarly numbered, while different parts bear different numbers. There is provided in the embodiment illustrated in FIG. 2 a conduit 9 which terminates in gasket 19 and opens into chamber 11 via flap door 15 rotatable about hinge 17. Chamber 11 terminates in bushing 23' which serves the same purpose as bushing 23 described hereinabove with respect to the embodiment of FIG. 1. In this respect, bushing 23' is of a resilient plastic or rubber which may be beveled slightly in a diverging fashion from entrance to exit thereby to provide the type of "hold" for ball 5 which "hold" may be overcome by the pressure in chamber 11 as hereinafter described. Bushing 23' may be replaceable and is held in place thereby forming a joint between chamber 11 and exit conduit 41, by simple resilient clamping mechanism 42 as illustrated.

Provided in conduit 9 at any convenient location prior to door 15 is a sensing means 61, which may be a conventional electric eye switch, connected to terminal board 65 conventionally circuited as illustrated so as to be able to activate a typical 24 volt power source P for actuating solenoid valve 70 which supplies air pressure via air line 30 to an audible or visible signal (in this instance, air horn 76). Air line 30 is, of course, connected to a source of air under pressure similarly as described with respect to FIG. 1. For the purposes of admitting air into chamber 11, there is provided a second sensing means 62 such as a conventional electric eye switch, which is circuited in a conventional fashion as illustrated at terminal board 77 thereby to be able to activate the 24 volt power source P (separate or the same one) which in turn can then activate a second solenoid switch 72 for admitting pressurized air thereby to pressurize chamber 11.

In a typical operation of the device illlustrated in FIG. 2, ball 5 passes through the hole of the target and into conduit 9 where it trips electric eye switch 61. Electric eye switch 61 in turn closes electric contacts at points F–G in terminal board 65 which in turn activates the 24 volt power source P to power solenoid valve 70 which supplies pressurized air by means of piping 30 to air horn 76 thereby signaling the player that a ball has entered conduit 9 (or pipe 112 or 118 as the case may be). Ball 5 continues through conduit 9 where it contacts door 15, pushing door 15 open and entering pressurizing chamber 11. Chamber 11 may be slanted slightly downwardly at an angle to the horizontal so that ball 5 continues to roll through chamber 11 until it comes to rest and lodges against the forward lips of bushing 23'. Just prior to lodging against bushing 23', however, ball 5 trips electric eye switch 62 which in turn closes the contacts at point M-N in terminal board 77. This in turn activates the power supply source P to thereby actuate solenoid valve 72, emitting air under pressure in a predetermined amount sufficient to blow ball 5 forcibly past the lips of bushing 23' into conduit 41 (or pipes 116 and 122).

In this respect, conventional adjusting means can be made in either the solenoid valve 72 or in the air pressure, or both, or similar adjusting means as shown in FIG. 1 can be provided in the top of chamber 11 rather than close off bolt 78 thereby to provide adjusting means for creating the desired pressure in chamber 11. Thus, in the initial phases of pressurization, door 15 is pushed shut against gasket 19 to seal the chamber and prevent any other ball from entering chamber 11. Pressurization then builds because of the retaining or "holding" feature in resilient bushing 23' such that pressure build up finally "blows" ball 5 with sufficient force to return it to its desired location via conduit 41.

In certain other embodiments of this invention, trip switch 27 and electric eye 62 in shooter 130 could be connectedd only to indicator 146 (and not connected to solenoid valve 29 or terminal board 77 as described above) which would then notify the player (by the "fire" light) that ball 5 was in the position to play. A trigger device would (not shown) then be provided for the player to pull. This trigger would activate either solenoid 29 (FIG. 1) or solenoid valve 72 (FIG. 2) depending on which embodiment was being employed.

This game apparatus is operated substantially as set forth above. The balls to be played are dispensed to each player from control unit 100 through pipes 138 to the player's shooting bay 126. The player then pulls back loading lever 140 when he is ready to play. This loads a ball into shooter 130 through conduit 9. This ball is either shot automatically by shooter 130 as discussed above in relation to FIGS. 1 and 2, or by a trigger device (not shown). The ball when shot is projected by exit conduit 41 towards target stand 104. If the player is "on target" and the ball goes into one of the target holes 108, the ball will return to the control room via a pipe 136, pipe 112, ball ejection unit 114 and return pipe 116 as discussed above. The ball may be color coded to determine which player made the shot so that the right player can be recognized and properly rewarded.

If the player is off target with his shot such that it hits target stand 104 and bounces back onto sloped area 132, the ball will be returned to control unit 100 via a pipe 133, pipe 118, ball ejection unit 120 and return pipe 122.

Multiple players could play to a single target stand 104 as shown in FIG. 1. As discussed above, the balls could be color-coded to identify their origin. Also, the pipes 112 and 118 are long enough such that they could hold a number of balls waiting to be returned to control unit 100.

In certain preferred embodiments of this invention shooter 130 is in the shape of a conventional gun, and is mounted on a swivel platform such that the gun can be freely rotated.

Once given the above disclosure, many other features, modifications and improvements will become apparent to be skilled artisan. Such other features, modifications and improvements are, therefore, considered a part of this invention, the scope of which is to be determined by the following claims.

I claim:

1. A game apparatus for projecting balls through space towards a target comprising:

a ball ejection unit having a pressurizable ball receiving chamber with a ball entrance opening therein, a door for closing said opening, an exit located in said ball receiving chamber through which said ball is able to pass when the chamber is under pressure, a source of fluid under pressure, means for admitting the fluid under pressure into said chamber in an amount sufficient to drive the ball from the chamber, an exit conduit that the ball passes through after the ball has been driven from the chamber, a control means for operating said fluid admitting means, said control means designed and arranged to be operated by a hand of a person playing said apparatus while the person is in the process of playing said game, a ball entrance pipe leading into said ball entrance opening, said ball entrance pipe and said ball receiving chamber being designed and arranged such that said ball enters said ball receiving chamber by the force of gravity, said ball receiving chamber being approximately horizontal with the ball entrance opening at one end and the exit located at the other end.

2. A game apparatus according to claim 1 wherein the control means includes a trigger which said person squeezes to operate said fluid admitting means.

3. A game apparatus according to claim 2 further comprising a second means for controlling the direction of said exit conduit.

4. A game according to claim 1 further comrising:

a target, said target having at least one hole therein to receive said balls, a control unit for dispensing balls to said game apparatus, a first piping assembly to connect said target to said control unit, a second piping assembly to connect said control unit to said projecting apparatus, wherein said first piping assembly includes a first ball return means for returning balls from said target to said control unit, said ball return means including a second ball ejection unit, a first pipe connecting said target hole to said second ball ejection unit, and a second pipe connecting said second ball ejection unit to said control unit.

5. A game according to claim 4 further comprising a target area, said target area being adjacent to said target such that most balls if they miss the target hole but bounce off the target will land in said target area, said target area having at least one hole therein and being sloped downhill from its periphery to said hole, and second ball return means for returning said ball from said target area to said control unit including a third ball ejection unit, and a third pipe connecting said target area holes to said third ball ejection unit and a fourth pipe connecting said third ball ejection unit to said control unit.

6. A game according to claim 5 wherein said second and said third ball ejection units further comprise means for sensing the presence of a ball in the chamber and thereafter generating a signal to said fluid admitting means to admit fluid under pressure into said chamber, thereby to drive said ball from said chamber.

7. A game according to claim 6 wherein said target, said control unit, and said projection means are located on a surface and wherein said second ball ejection unit, said third ball ejection unit, said second pipe, said third pipe and said fourth pipe are located beneath said surface.

8. A game apparatus according to claim 1 wherein said door opens inwardly into said chamber when said ball passes therethrough.

9. A game apparatus according to claim 8 wherein said door is sealably closed upon admission of said fluid under pressure into said chamber.

10. A game apparatus according to claim 9 wherein said exit includes a bushing having an orifice therein of a diameter less than the diameter of said ball, but which is capable of being stretched to a diameter slightly greater than the diameter of said ball.

* * * * *